US006644802B2

(12) United States Patent
Minowa

(10) Patent No.: US 6,644,802 B2
(45) Date of Patent: Nov. 11, 2003

(54) IMAGE-FORMING METHOD AND PRINTING MEDIUM AND SHEET CARTRIDGE THEREFOR

(75) Inventor: Yoshiki Minowa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 27 days.

(21) Appl. No.: 10/045,647

(22) Filed: Jan. 11, 2002

(65) Prior Publication Data

US 2002/0105570 A1 Aug. 8, 2002

(30) Foreign Application Priority Data

Jan. 22, 2001 (JP) ..... 2001-013698

(51) Int. Cl.[7] ..... B41J 2/01

(52) U.S. Cl. ..... 347/105; 347/101; 347/100; 428/195

(58) Field of Search ..... 347/103, 105, 347/102, 101, 1, 98, 95, 106, 100, 84; 428/195, 32.1, 143, 364, 153, 189; 346/135.1; 106/31.13; 156/247

(56) References Cited

U.S. PATENT DOCUMENTS 5,487,614 A * 1/1996 Hale ..... 347/103
6,000,793 A * 12/1999 Inamoto ..... 347/101
6,372,689 B1 * 4/2002 Kuga et al. ..... 428/195

FOREIGN PATENT DOCUMENTS

JP 10-058638 3/1998
JP 10-244788 * 9/1998 ..... B41M/5/00

* cited by examiner

*Primary Examiner*—Stephen D. Meier
*Assistant Examiner*—Manish Shah
(74) *Attorney, Agent, or Firm*—Hogan & Hartson, LLP

(57) ABSTRACT

There is provided an image-forming method which is capable of carrying out edge-to-edge properly on a medium such as a card, and a print medium and a sheet cartridge for use in the image-forming method. An image is printed on an ink image-receiving sheet by using a sublimable dye ink, thereby causing the sublimable dye ink to be held by the ink image-receiving sheet. The image is fixed on the medium body by heating the ink image-receiving sheet and a medium body overlaid to each other and thereby causing diffusion of the sublimable dye ink held in the ink image-receiving sheet on a surface of the medium body for color development. Then, the ink image-receiving sheet is removed from the medium body having the image fixed thereon. In this image-forming method, the ink image-receiving sheet is formed to have a larger size than the medium body.

16 Claims, 10 Drawing Sheets

IMAGE-FORMING METHOD AND PRINTING MEDIUM AND SHEET CARTRIDGE THEREFOR

BACKGROUND OF THE INVENTION

1. Field of the Invention

This invention relates to an image-forming method for printing images by using sublimable dye ink, and a print medium and a sheet cartridge for use in the method.

2. Prior Art

Conventionally, dye sublimation printers capable of printing color images on print media by using sublimable dye ink include two types, i.e. a thermal sublimation printer and an ink-jet type sublimation printer. The ink-jet type sublimation printer carries out printing by ejecting sublimable dye ink onto a print medium having an ink image-receiving layer formed on a surface thereof for receiving sublimable dye ink, and then heats the print medium to sublime/diffuse the droplets of the sublimable dye ink ejected onto the print medium, thereby forming an image. The ink image-receiving layer of the print medium is laminated on a surface of a medium body of the print medium by coating the same in the form of a layer.

However, in such a conventional image-forming method using the above print medium, since the laminated ink image-receiving layer has a surface identical in width to that of the medium body of the print medium, when printing is effected on the whole surface of the print medium from edge to edge (i.e. when so-called edge-to-edge printing is effected) by the ink jet printing method, ink droplets are liable to be deposited even on the end faces of the print medium. As a result, the print medium subjected to edge-to-edge printing is provided in a state of its end faces being stained unintentionally, which causes user discomfort. Apparently, it is possible to avoid this problem if the edge portions of the surface of the print medium are not used for printing. However, in this case, the unprinted edge portions are conspicuous for absence of a background color, which diminishes the value of the print medium as a product.

SUMMARY OF THE INVENTION

It is an object of the invention to provide an image-forming method which is capable of properly carrying out edge-to-edge printing on a medium, such as a card, without staining the end faces thereof, and a print medium and a sheet cartridge for use in the method.

To attain the above object, according to a first aspect of the invention, there is provided an image-forming method comprising the steps of:

- printing an image on an ink image-receiving sheet by using a sublimable dye ink, thereby causing the sublimable dye ink to be held by the ink image-receiving sheet;
- fixing the image in a surface of a medium body by heating the ink image-receiving sheet and the medium body overlaid to each other and thereby causing diffusion of the sublimable dye ink held in the ink image-receiving sheet in the surface of the medium body for color development; and
- removing the ink image-receiving sheet from the medium body having the image formed thereon,
- wherein the ink image-receiving sheet is larger in size than the surface of the medium body.

According to this image-forming method, when an image is printed on the print medium, the sublimable dye ink is impregnated into the ink image-receiving sheet and held in the same. Then, heating of the print medium in this state causes evaporation and diffusion of the sublimable dye ink from the ink image-receiving sheet deep into the surface layer of the medium body as migration particles having sizes at a molecular level, and color development to form an image thereon. Then, the ink image-receiving sheet is removed from the medium body to expose the surface of the medium body, whereby a highly durable medium body having the image formed thereon is easily provided.

Further, the ink image-receiving sheet capable of temporarily holding the sublimable dye ink is slightly larger than the medium body, so that by carrying out printing on an area slightly beyond the size of the medium body, print image can be transferred properly onto the whole or edge-to-edge surface of the medium body in the step of fixing the image.

In this connection, it is preferred that a lamp light source formed e.g. by a halogen lamp is used for heat treatment carried out in the step of fixing the image.

Preferably, the ink image-receiving sheet has a separator affixed to a surface thereof, for protection of the surface, and the image-forming method further including the step of peeling off the separator before the step of printing.

According to this preferred embodiment, since the ink image-receiving sheet keeps the separator on the printing surface thereof which serves as an image-receiving surface for receiving the sublimable dye ink, until printing is effected, it is possible to protect the printing surface of the ink image-receiving sheet properly until execution of the step of printing. Further, when print media are stored in a state stacked one upon another, it is possible to prevent an ink image-receiving sheet from sticking to another medium body, which facilitates management of the print media.

Preferably, the medium body has a fluorine film layer laminated on a surface thereof.

According to this preferred embodiment, when the ink image-receiving sheet is heated, the sublimable dye ink held in the ink image-receiving sheet passes through the fluorine film layer, followed by being diffused and fixed in the surface layer of the medium body. Then, after the ink image-receiving sheet is removed, the image fixed in the surface layer of the medium body is protected by the fluorine film layer as an outermost surface layer thereof. As a result, the image is properly protected by the fluorine film layer functioning similarly to a laminating film. At the same time, the surface of the medium body becomes not only weather-resistant, light-resistant, heat-resistant, rub or abrasion-resistant and chemical-resistant, but also glossy due to characteristics of the fluorine film layer.

Preferably, the ink image-receiving sheet is peelably affixed to the surface of the medium body.

According to this preferred embodiment, a print medium can be provided in a state of the ink image-receiving sheet laminated on the surface of the medium body thereof. This makes it possible to prevent the ink image-receiving sheet from being displaced from the medium body and hence to subject the print medium in a stable fashion to the step of printing and the step of fixing the image. Further, it is possible to peel the ink image-receiving sheet off the medium body with ease in the step of removing the ink image-receiving sheet.

More preferably, the ink image-receiving sheet is formed of a material which is made easy to peel off by heating.

According to this preferred embodiment, the ink image-receiving sheet overlaid and affixed to the medium body can be easily peeled off after being heated in the step of fixing the image. Therefore, the ink image-receiving sheet can be easily peeled off the medium body in the step of removing the ink image-receiving sheet. However, it cannot be peeled off easily before being heated, and hence it is possible to prevent degradation of ease of handling of the medium body and the ink image-receiving sheet.

More preferably, the ink image-receiving sheet is continuous with respect to a plurality of the medium bodies.

According to this preferred embodiment, a single ink image-receiving sheet is affixed to surfaces of a plurality of medium bodies in a manner covering the medium bodies. Therefore, the plurality of medium bodies can be collectively provided by a single unit. It should be noted that the plurality of medium bodies may be affixed to the single ink image-receiving sheet with predetermined spaces provided therebetween.

Further preferably, the plurality of medium bodies are integrally formed in a state separable from each other along cutting lines.

According to this preferred embodiment, since the plurality of medium bodies formed as a single unit can be easily separated from each other by being cut off or punched out along the cutting lines. Accordingly, this method is advantageous particularly in batch processing which is carried out by subjecting the plurality of medium bodies as a single unit to the step of printing and the step of fixing the image.

Preferably, the ink image-receiving sheet and the medium body are formed separately, and the image-forming method further including the step of overlaying an ink-holding portion of the ink image-receiving sheet to the surface of the medium body and affixing the ink image-receiving sheet to the medium body.

According to this preferred embodiment, when an image is printed on the print medium, the sublimable dye ink is impregnated into the ink image-receiving sheet and held in the same. Then, the ink-holding portion of the ink image-receiving sheet impregnated with the sublimable dye ink is properly positioned and overlaid to the medium body. Further, when heat treatment is carried out in this state, this causes evaporation and diffusion of the sublimable dye ink from the ink image-receiving sheet deep into the surface layer of the medium body as migration particles having sizes at a molecular level, and color development to form the image therein. Then, the ink image-receiving sheet is removed from the medium body, whereby a highly durable medium body having the image formed thereon is easily provided.

Further, the ink image-receiving sheet capable of temporarily holding the sublimable dye ink is slightly larger than the medium body, so that by carrying out printing on an area slightly beyond the size of the medium body, print image can be transferred properly onto the whole or edge-to-edge surface of the medium body in the step of fixing the image.

More preferably, the ink image-receiving sheet is rolled out from a roll thereof.

According to this preferred embodiment, it is possible to easily manage the ink image-receiving sheet as well as to carry out continuous printing on the same.

Further preferably, the ink image-receiving sheet has a separator affixed to an image-receiving surface thereof, for protection of the surface, and the image-forming method further includes the step of peeling off the separator before the step of printing.

According to this preferred embodiment, the ink image-receiving sheet can be wound into a roll while causing the separator to impart appropriate rigidity thereto. Further, until the sheet is subjected to the step of printing, the image-receiving surface thereof can be properly protected, and sticking of a back surface of the sheet in a roll to the ink-receiving surface can be prevented, which further facilitates management of the ink image-receiving sheet.

Further preferably, the ink image-receiving sheet removed from the medium body is taken up.

According to this preferred embodiment, it is possible to easily manage the used ink image-receiving sheet. Further, the used ink image-receiving sheet can be discarded in the form of a roll.

Further preferably, the ink image-receiving sheet has a separator affixed to an opposite surface thereof to an image-receiving surface thereof, for protection of the image-receiving surface, and the image-forming method further including the step of separating the ink image-receiving sheet and the medium body overlaid and affixed to each other from the separator, after the step of overlaying and before the step of fixing the image.

According to this preferred embodiment, the ink image-receiving sheet having the separator affixed to the opposite surface thereof to the image-receiving surface thereof is wound into a roll with rigidity imparted thereto by the separator. In this case, first in the step of printing, an image is printed on the image-receiving surface of the ink image-receiving sheet with the separator affixed thereto, and then the medium body is laminated on the ink-holding portion of the image-receiving surface. Thereafter, the ink image-receiving sheet having the medium body affixed to the ink-holding portion thereof is separated from the separator, whereby the image-forming process can proceed to the step of fixing the image. It is preferred that either the ink image-receiving sheet or the medium body is coated with an adhesive.

Still more preferably, the separator which has been separated from the ink image-receiving sheet and the medium body is taken up.

According to this preferred embodiment, it is possible to easily manage the used separator which is no longer needed for imparting rigidity to the ink image-receiving sheet. Further, the used ink image-receiving sheet (separator) can be discarded in the form of a roll.

Preferably, the ink image-receiving sheet and the medium body are formed separately, the ink image-receiving sheet having a separator affixed to an image-receiving surface thereof, and the image-forming method further including the step of overlaying the medium body to an opposite surface of the ink image-receiving sheet to an image-receiving surface thereof and affixing the medium body to the ink image-receiving sheet, and the step of separating the ink image-receiving sheet and the medium body from the separator, before the step of printing.

According to this preferred embodiment, first, a medium body is overlaid and laminated on the opposite surface of the ink image-receiving sheet to the surface (image-receiving surface) thereof having the separator affixed thereto, and then the ink image-receiving sheet having the medium body affixed thereto is separated from the separator to subject the ink image-receiving sheet and the medium body to the step of printing. In the step of printing, when an image is printed on the ink image-receiving sheet, the sublimable dye ink is impregnated into the ink image-receiving sheet and held in the same. Then, heat treatment carried out in this state causes evaporation and diffusion of the sublimable dye ink from the ink image-receiving sheet deep into the surface layer of the medium body as migration particles having sizes at a molecular level, and color development to form the image thereon. Then, the ink image-receiving sheet is removed from the medium body, whereby a highly durable medium body having the image formed thereon is easily provided.

Further, the ink image-receiving sheet capable of temporarily holding the sublimable dye ink is slightly larger than the medium body, so that by carrying out printing on an area slightly beyond the size of the medium body, a print image can be transferred properly onto the whole or edge-to-edge surface of the medium body in the following step of fixing the image, without staining the end faces of the medium body.

More preferably, the ink image-receiving sheet is rolled out from a roll thereof.

According to this preferred embodiment, it is possible to easily manage the ink image-receiving sheet.

Further preferably, the separator which has been separated from the ink image-receiving sheet and the medium body is taken up.

According to this preferred embodiment, it is possible to easily manage the used separator which is no longer needed for imparting rigidity to the ink image-receiving sheet.

More preferably, the ink image-receiving sheet is formed of a material which is made easy to peel off by heating.

According to this preferred embodiment, the ink image-receiving sheet overlaid and affixed to the medium body can be easily peeled off after being heated in the step of fixing the image. Therefore, the ink image-receiving sheet can be easily peeled off the medium body in the step of removing the ink image-receiving sheet. However, it cannot be peeled off easily before being heated, and hence it is possible to prevent degradation of ease of handling of the medium body and the ink image-receiving sheet.

Preferably, the medium body has a fluorine film layer laminated on a surface thereof to which the ink image-receiving sheet is overlaid.

According to this preferred embodiment, when the ink image-receiving sheet is heated, the sublimable dye ink held in the ink image-receiving sheet passes through the fluorine film layer, followed by being diffused and fixed in the surface layer of the medium body. Then, after the ink image-receiving sheet is removed, the image fixed in the surface layer of the medium body is protected by the fluorine film layer as an outermost surface layer thereof. As a result, the image is properly protected by the fluorine film layer functioning similarly to a laminating film. At the same time, the surface of the medium body becomes not only weather-resistant, light-resistant, heat-resistant, rub or abrasion-resistant and chemical-resistant, but also glossy due to characteristics of the fluorine film layer.

Preferably, the medium body is a card.

According to this preferred embodiment, it is possible to carry out so-called whole surface or edge-to-edge printing on a card properly, so that even when a card having a predetermined thickness is used, deposition of ink on the side faces thereof can be prevented. In short, it is possible to easily produce a card excellent in print quality and abrasion or rub resistance.

Preferably, the step of printing includes printing by an ink jet printing method.

According to this preferred embodiment, it is possible to print a clear image to the edges of the medium body while properly preventing ink droplets ejected by the ink jet printing method from being deposited on the end faces of the medium body. Particularly in color printing, the ink jet printing method is more advantageous than the thermal sublimation printing method using ink films of the three primary colors, in that it is possible to reduce ink usage and increase printing speed as well as to obtain an image with high resolution.

To attain the above object, according to a second aspect of the invention, there is provided a print medium comprising:

a medium body having a surface; and an ink image-receiving sheet larger in size than the surface of the medium body;

the print medium being used in an image-forming method comprising the steps of:

printing an image on an ink image-receiving sheet by using a sublimable dye ink, thereby causing the sublimable dye ink to be held by the ink image-receiving sheet;

fixing the image in the surface of the medium body by heating the ink image-receiving sheet and the medium body overlaid to each other and thereby causing diffusion of the sublimable dye ink held in the ink image-receiving sheet in the surface of the medium body for color development; and removing the ink image-receiving sheet from the medium body having the image formed thereon.

According to the second aspect, it is possible to provide a print medium suitable for the above image-forming method.

Preferably, the print medium of the second aspect configured to have an identical member-lamination structure on both of a front surface side and a back surface side thereof, such that images can be formed on both of the front surface side and the back surface side thereof.

According to this preferred embodiment, the print medium can be used for double-sided printing. More specifically, by removing ink image-receiving sheets from the upper and lower surfaces of the print medium, respectively, and exposing the opposite surfaces of a medium body of the print medium, it is possible to provide the medium body subjected to double-sided printing.

To attain the above object, according to a third aspect of the invention, there is provided a sheet cartridge for use in an image-forming method, the image-forming method including the steps of:

printing an image on an ink image-receiving sheet rolled out from a roll thereof, by using a sublimable dye ink, thereby causing the sublimable dye ink to be held by the ink image-receiving sheet, the ink image-receiving sheet being larger in size than a surface of a medium body and formed separately from the medium body, overlaying an ink-holding portion of the ink image-receiving sheet to the surface of the medium body and affixing the ink image-receiving sheet to the medium body, fixing the image in the surface of the medium body by heating the ink image-receiving sheet and the medium body overlaid to each other and thereby causing diffusion of the sublimable dye ink held in the ink image-receiving sheet in the surface of the medium body for color development, removing the ink image-receiving sheet from the medium body having the image formed thereon, and taking up the ink image-receiving sheet removed from the medium body, the sheet cartridge comprising:

the roll of the ink image-receiving sheet;

a supply reel for rolling out the ink image-receiving sheet therefrom;

a sheet take-up reel for taking up the ink image-receiving sheet rolled out; and a single cartridge casing accommodating the roll of the ink image-receiving sheet, the supply reel, and the sheet take-up reel.

Similarly, according to a fourth aspect of the invention, there is provided a sheet cartridge for use in an image-forming method, the image-forming method including the steps of:

printing an image on an ink image-receiving sheet rolled out from a roll thereof, by using a sublimable dye ink, thereby causing the sublimable dye ink to be held by the ink image-receiving sheet, the ink image-receiving sheet being larger in size than a surface of a medium body, formed separately from the medium body, and having a separator affixed to an opposite surface thereof to an image-receiving surface thereof for receiving an image of the sublimable dye ink, overlaying an ink-holding portion of the ink image-receiving sheet to the surface of the medium body and affixing the ink image-receiving sheet to the medium body, separating the ink image-receiving sheet and the medium body overlaid and affixed to each other from the separator, fixing the image in the surface of the medium body by heating the ink image-receiving sheet and the medium body overlaid to each other and thereby causing diffusion of the sublimable dye ink held in the ink image-receiving sheet in the surface of the medium body for color development, removing the ink image-receiving sheet from the medium body having the image formed thereon, and taking up the separator separated from the ink image-receiving sheet and the medium body, the sheet cartridge comprising:

the roll of the ink image-receiving sheet;

a supply reel for rolling out the ink image-receiving sheet;

a separator take-up reel for taking up the separator removed from the medium body; and a single cartridge casing accommodating the ink image-receiving sheet, the supply reel, and the sheet take-up reel.

Similarly, according to a fifth aspect of the invention, there is provided a sheet cartridge for use in an image-forming method, the image-forming method including the steps of:

overlaying a medium body to an image-receiving surface of an image-receiving sheet formed separately from the medium body, the image-receiving surface being for receiving an image of a sublimable dye ink, and affixing the medium body and the image-receiving sheet to each other, the ink image-receiving sheet being larger in size than a surface of the medium body, having a separator affixed to an opposite surface thereof to the image-receiving surface thereof, and being rolled out from a roll thereof, separating the ink-receiving sheet and the medium body overlaid and affixed to each other from the separator, printing an image on the image-receiving surface of the ink image-receiving sheet, by using the sublimable dye ink, thereby causing the sublimable dye ink to be held by the ink image-receiving sheet, fixing the image in the surface of the medium body by heating the ink image-receiving sheet and the medium body overlaid to each other and thereby causing diffusion of the sublimable dye ink held in the ink image-receiving sheet in the surface of the medium body for color development, removing the ink image-receiving sheet from the medium body having the image formed thereon, and taking up the separator separated from the ink image-receiving sheet and the medium body, the sheet cartridge comprising:

the roll of the ink image-receiving sheet;

a supply reel for rolling out the ink image-receiving sheet;

a separator take-up reel for taking up the separator removed from the medium body; and a single cartridge casing accommodating the roll of the ink image-receiving sheet, the supply reel, and the sheet take-up reel.

The sheet cartridge of these aspects make it possible to easily manage the ink image-receiving sheet whether it may be unused or used. More specifically, the cartridges make it easy to handle the ink image-receiving sheet for transport or storage. Further, after the ink image-receiving sheet is used up, it is possible to replace the sheet cartridge with a new one, thereby readily providing a new ink image-receiving sheet.

The above and other objects, features, and advantages of the invention will become more apparent from the following detailed description taken in conjunction with the accompanying drawings.

BRIEF DESCRIPTION OF THE DRAWINGS

FIGS. 1A and 1B show structures of print media for use in an image-forming method according to a first embodiment of the invention, in which:

FIG. 1A is a cross-sectional view of an inexpensive print medium;

FIG. 1B is a cross-sectional view of a high-grade print medium;

DETAILED DESCRIPTION OF PREFERRED EMBODIMENTS

The invention will now be described in detail with reference to drawings showing embodiments thereof. In the following, description is given of respective cases where an image-forming method of the invention is executed by using a plurality of kinds of image-forming apparatuses, each of which prints images of letters, figures, a background, and so forth, on a print medium (card) by an ink jet printing method using sublimable dye ink, and then applies heat treatment to the print medium after printing to thereby fix the images thereto. In these cases, the image-forming apparatuses use different types of print media, respectively. Therefore, the following description will proceed while associating a print medium for use with a corresponding one of the image-forming apparatuses.

Figure 1A:
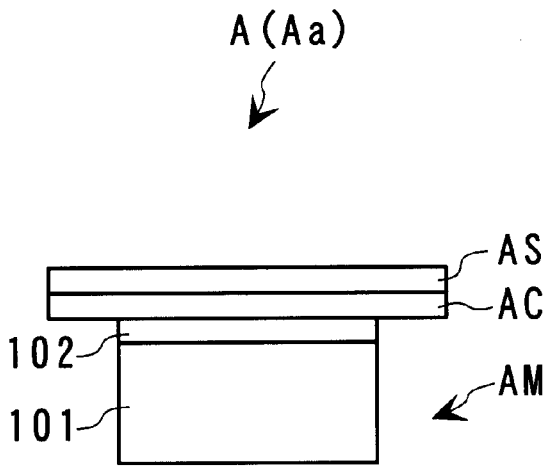
Figure 1B:
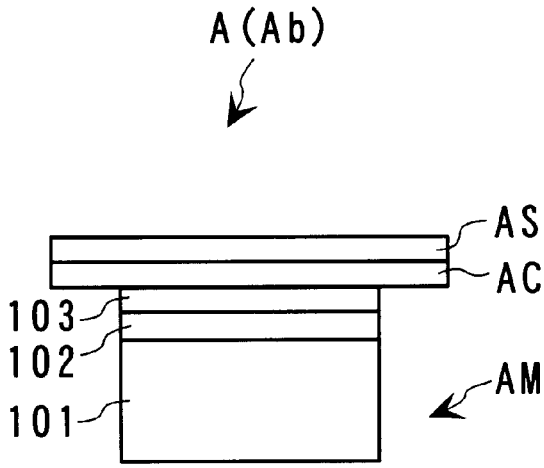
Figure 2:
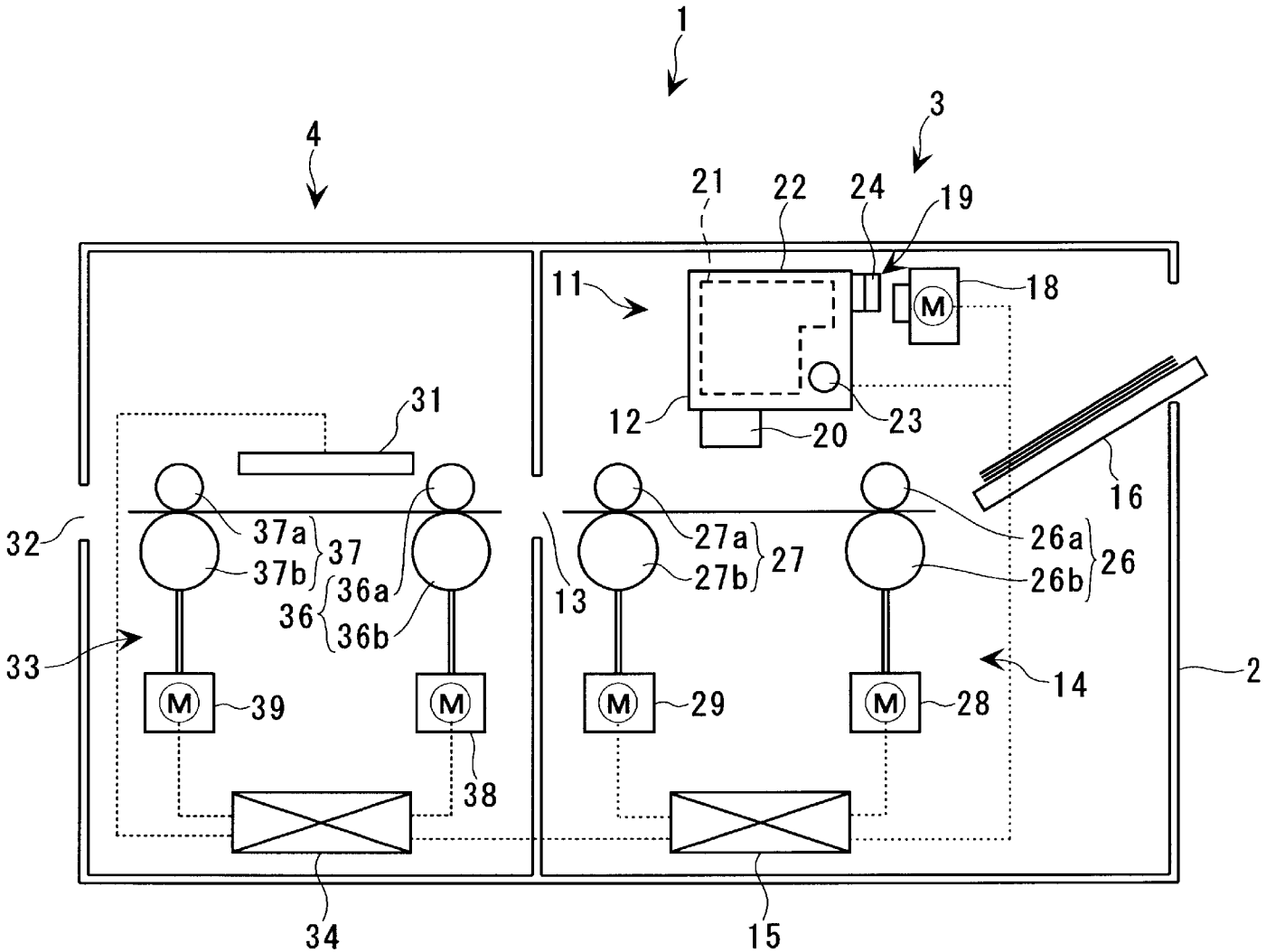
FIG. 2 is a cross-sectional view schematically showing the arrangement of an image-forming apparatus to which is applied the image-forming method according to the first embodiment.
Figure 3A:
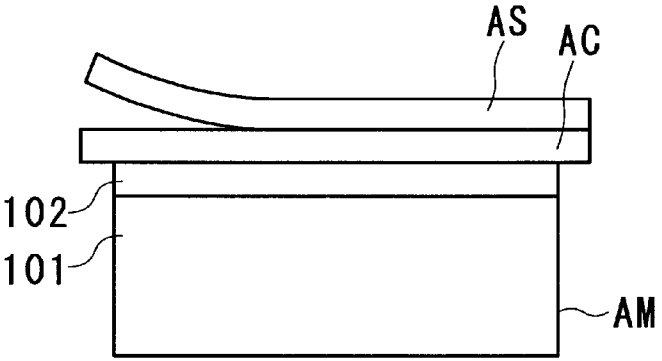
FIGS. 3A to 3D are cross-sectional views of a print medium, schematically illustrating a process of an image being formed on the print medium.
Figure 3B:
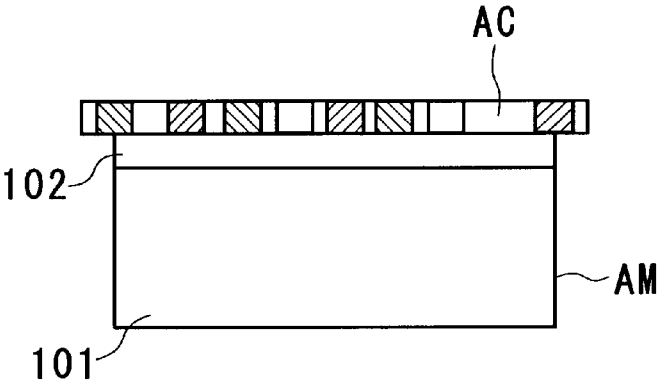
Figure 3C:
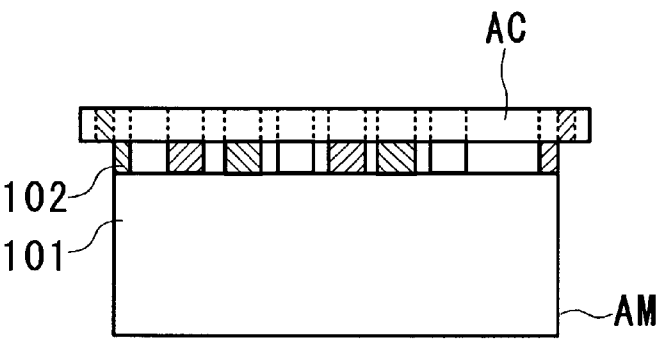
Figure 3D:
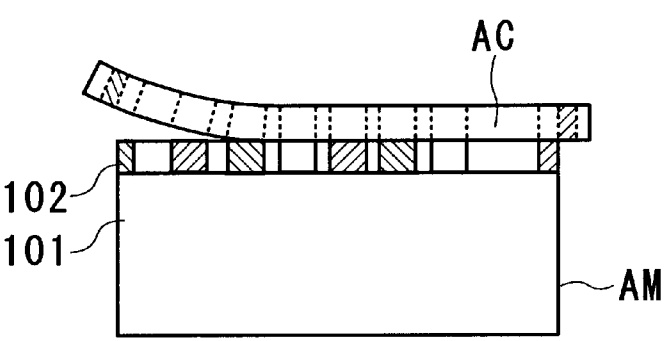

FIGS. 1A and 1B show print media for use by an image-forming apparatus according to a first embodiment of the invention, while FIG. 2 schematically shows the arrangement of the image-forming apparatus. As shown in FIGS. 1A, 1B, in the present embodiment, there are provided two kinds of print media A, i.e. an inexpensive print medium Aa (FIG. 1A) and a high-grade print medium Ab (FIG. 1B). The two print media Aa, Ab are each comprised of a medium body AM as a body of the print medium A, and an ink image-receiving sheet AC laminated on the surface of the medium body AM. A separator AS is affixed to the surface of the ink image-receiving sheet AC. The medium body AM may be a roll paper, a printing tape or a cut sheet, but in the present embodiment, description will be given by taking a card as an example.

The medium body AM is comprised of a substrate layer 101 and an ink-fixing layer 102 laminated on the surface of the substrate layer 101 (see FIG. 1A). The print medium Ab shown in FIG. 1B further has a fluorine film layer 103 laminated, in place of a laminating film, on the surface of the ink-fixing layer 102, i.e. on the surface of the medium body AM.

The substrate layer 101 is formed of a plastic film e.g. of PVC (polyvinyl chloride) or PET (polyethylene terephthalate), or a synthetic paper so as to maintain the rigidity of the entire card. Further, in general, the substrate layer 101 is basically formed of a white material. The ink-fixing layer 102 is formed e.g. of a transparent PET film and functions as a layer into which sublimable dye ink used for printing penetrates at the final stage of the image-forming process. The ink image-receiving sheet AC is affixed to the surface of the medium body AM, i.e. the surface of the ink-fixing layer 102.

The ink image-receiving sheet AC is formed of a hydrophilic resin material which is capable of temporarily holding the sublimable dye ink directly ejected thereon for printing and made easy to peel by heating. In other words, the ink image-receiving sheet AC cannot be easily peeled off before being heated, whereas after being heated, it becomes easy to peel off.

Further, the ink image-receiving sheet AC is formed to have a size in plan view larger than the medium body AM. More specifically, the ink image-receiving sheet AC has a surface width slightly larger than that of the medium body AM and is laminated to the medium body AM such that it covers even the end faces of the surface of the medium body AM. Moreover, the ink image-receiving sheet AC has an opposite surface to a surface thereof having the ink-fixing layer 102 affixed thereto, i.e. a surface for receiving an image of sublimable dye ink, protected by the separator AS.

The separator AS is formed of a resin material or high-quality paper e.g. of a silicon-based material and affixed to the ink image-receiving sheet AC thereunder to protect the same from dust and dirt. Further, when print media A are stored in a state stacked one upon another, the separator AS of each print medium A prevents the ink image-receiving sheet AC from adhering to a surface of another print medium A. When the separator AS is peeled off the print medium A, the ink image-receiving sheet AC is exposed, whereby the print medium is made ready for forming an image on the medium body AM via the ink image-receiving sheet AC.

More specifically, as shown in FIGS. 3A to 3D, when the separator AS is removed and an image is printed by the ink jet printing method on an ink image-receiving sheet AC which is exposed, ink droplets of the sublimable dye ink are impregnated into the ink image-receiving sheet AC and held in the same. The ink droplets penetrate to the proximity of the boundary between the ink image-receiving sheet AC and the ink-fixing layer 102 thereunder. When the print medium A is heated in this state, the ink droplets further penetrate deep into the ink-fixing layer 102 as migration particles having sizes at a molecular level. More specifically, the ink droplets held in the ink image-receiving sheet AC are heated to be evaporated/diffused and subjected to color development in the ink-fixing layer 102, whereby the image is formed and fixed in the ink-fixing layer 102. Thereafter, the ink image-receiving sheet AC is separated (removed) to expose the ink-fixing layer 102, whereby the card having the image fixed in the ink-fixing layer 102 is produced.

In this case, the ink image-receiving sheet AC is formed to have a slightly larger size than the medium body AM, so that even when printing is effected up to a position slightly beyond the surface of the medium body AM, ink droplets ejected are received by the ink image-receiving sheet AC and held in the same, which prevents deposition of the ink droplets on the side faces of the medium body AM. As a natural consequence, the image transferred onto the medium body AM through this printing including the off-area printing looks clear even on edges of the medium body AM.

Similarly, when the FIG. 1B print medium Ab having the fluorine film layer 103 laminated thereon is used for printing, ink droplets are impregnated into the ink image-receiving sheet AC and held in the same. When the print medium Ab is heated in this state, the ink droplets pass through the fluorine film layer 103, followed by being diffused and fixed in the ink-fixing layer 102. Then, after the ink image-receiving sheet AC is peeled off, the card having the fluorine film layer 103 as an outermost surface layer thereof for protecting an image fixed in the ink-fixing layer 102 is produced. Thus, the card having the image formed thereon is made more excellent in weather resistance, light resistance, heat resistance, rub or abrasion resistance and chemical resistance due to characteristics of the fluorine film layer 103. Further, the fluorine film layer 103 gives a high gloss to the card.

Next, the image-forming apparatus for forming an image on the print medium A will be described with reference to FIG. 2. The image-forming apparatus 1 has an apparatus body including an outer shell formed by a box-shaped casing 2, a printer block 3 arranged at a location rightward of the central portion of the apparatus body, for printing on a print medium A, and a heater block 4 arranged at a location leftward of the same for applying heat treatment to the printed print medium A.

The printer block 3 includes a printer device 11 which carries out printing on the print medium A by a head unit 12 which is driven for reciprocating motion, a printer-block conveyor device 14 for carrying the print medium A along a transport passage 13 to the printer device 11, and a printer-side controller 15 which carries out centralized control of operations of the devices 11 and 14. Further, in the printer block 3, there are arranged a media cartridge 16 and a feeder, not shown, which feeds print media, one by one, to the printer device 11.

The printer device 11 is comprised of the head unit 12, a carriage motor 18 as a drive source, and a reciprocating mechanism 19 which receives torque from the carriage motor 18 and drives the head unit 12 for reciprocating motion in a direction orthogonal to the direction of feeding of the print medium A. The head unit 12 is comprised of an ink jet head 20 having a plurality of nozzles formed in an underside surface thereof, an ink cartridge 21 which supplies ink to the ink jet head 20, and a carriage 22 carrying the ink jet head 20 and the ink cartridge 21. The ink cartridge 21 contains sublimable dye inks of four colors, i.e. yellow, cyan, magenta, and black. The ink cartridge 21 may contain inks of six colors including two other colors, i.e. light cyan and light magenta, in addition to the above four.

The sublimable dye inks are each comprised of a sublimable dye and are sublimable when exposed to heat. As described above, each sublimable dye ink is impregnated into the ink image-receiving sheet AC and temporarily held in the same. Then, the sublimable dye ink is transferred into the ink-fixing layer 102 under the ink image-receiving sheet AC by being heated in heat treatment, and diffused/evaporated in the ink-fixing layer 102, for color development.

The reciprocating mechanism 19 includes a carriage guide shaft 23 having opposite ends thereof supported by frames, not shown, and a timing belt 24 extending in parallel with the carriage guide shaft 23. The carriage 22 is supported by the carriage guide shaft 23 such that the carriage 22 can perform reciprocating motion. Further, the carriage 22 has a portion thereof fixed to the timing belt 24. When the carriage motor 18 drives the timing belt 24 via a pulley to cause the timing belt 24 to travel in the normal and reverse directions, the carriage 22 performs reciprocating motion while being guided by the carriage guide shaft 23. During this reciprocating motion of the carriage 22, ink is ejected from the ink jet head 20 as required, whereby printing is effected on the print medium A.

The printer-block conveyor device 14 includes a feed roller means 26 for receiving the print medium A from the feeder and feeding the same to a printing position of the head unit 12, a sender roller means 27 for receiving the print medium A from the feed roller means 26 and sending the same from the printer block 3 to the heater block 4, a feed motor 28 for driving the feed roller means 26, and a sender motor 29 for driving the sender roller means 27. More specifically, the feed roller means 26 is arranged at a location upstream of the printer device 11 in the direction of feeding of the print medium A, while the sender roller means 27 is arranged at a location downstream of the same.

The feed roller means 26 is comprised of a feed driven roller 26*a* positioned above and a feed drive roller 26*b* positioned below, the two rollers 26*a*, 26*b* being opposed to each other via the transport passage 13 (or the print medium A) along which each print medium A is carried. The feed drive motor 26*b* is connected to the feed motor 28, for driving the feed driven roller 26*a* for rotation. The feed driven roller 26*a* is a free roller urged toward the feed drive roller 26*b* by a spring, not shown. The print medium A brought to the feed roller means 26 is sandwiched between the feed driven roller 26*a* and the feed drive roller 26*b* and advanced as the feed driven roller 26*a* rotates in accordance with rotation of the feed drive roller 26*b*.

Similarly, the sender roller means 27 is comprised of a sender driven roller 27*a* positioned above and a sender drive roller 27*b* positioned below, the two rollers 27*a*, 27*b* being opposed to each other via the transport passage 13. The sender drive roller 27*b* is connected to the sender motor 29, for driving the sender driven roller 27*a* for rotation. The sender driven roller 27*a* is a free roller urged toward the sender drive roller 27*b* by a spring, not shown. The print medium A brought to the sender roller means 27 is sandwiched between the sender driven roller 27*a* and the sender drive roller 27*b* and advanced as the sender driven roller 27*a* rotates in accordance with rotation of the sender drive roller 27*b*. It should be noted that the feed motor 28 and the sender motor 29 may be implemented by a single motor. In this case, torque is transmitted to the feed roller means 26 and the sender roller means 27 via a torque-transmitting mechanism including a gear train and the like.

The printer-side controller 15 controls the printer device 11, the printer-block conveyor device 14, and so forth. The printer-side controller 15 causes the print medium A to be fed with an ink image-receiving sheet AC on its upside for proper printing. More specifically, in a sequence of printing operations, the print medium A fed from the feeder is intermittently advanced by intermittent rotation of each of the feed roller means 26 and the sender roller means 27, while the head unit 12 performs one reciprocating motion during each interval between the intermittent feeding operations to print one line. Each printing operation is performed by the ink jet method using the sublimable dye ink such that the feed of the print medium A and the reciprocating motion of the head unit 12 correspond to the main scanning and the sub scanning in printing technology.

In the present embodiment, printing is carried out on the print medium A up to an area slightly beyond the edges of a card as the medium body AM, for so-called edge-to-edge printing of images including a background image. In short, ink droplets are ejected by the ink jet head 20 even on to the area of the print medium A beyond the edges of the card. The print medium A has the ink image-receiving sheet AC slightly larger in size than the card, as described above, so that even when ejected on the area of the print medium A beyond the edges of the card, ink droplets are reliably impregnated into the ink image-receiving sheet AC and held in the same, which makes it possible to effect printing on the whole surface of the card laterally and longitudinally in a edge-to-edge fashion without staining the end faces of the card.

The heater block 4 includes a heater device 31 which applies heat treatment to the print media A being sent from the printer block 3 after printing, a heater-block conveyor device 33 which carries the print media A received from the printer-block conveyor device 14 along the transport passage 13 so as to pass the print media A through the heater device 31 and then delivers the same out of the casing 2 via the card exit 32, and a heater-side controller 34 which performs centralized control of operations of the devices 31, 33.

The heater device 31 is formed by a so-called non-contact heater which faces the print medium A being send forward, in a spaced non-contacting fashion. The heater device 31 is arranged above the transport passage 13 and connected to the printer-side controller 15, which controls the heating temperature of the heater device 31. Preferably, the heater device 31 is formed e.g. by a halogen lamp as a light source, which generates light having short wavelengths. This makes it possible to properly heat the front surface or ink image-receiving sheet AC of the print medium A in a state of heat transmission to the substrate layer 101 being suppressed.

The heater-block conveyor device 33 includes a feed roller means 36 for receiving the print medium A from the printer block 3 and feeding the same to the heater device 31, a discharge roller means 37 for receiving the print medium A from the feed roller means 36 and discharging the same from the casing 2, a feed motor 38 for driving the feed roller means 36, and a discharge motor 39 for driving the discharge roller means 37. The feed roller means 36 is arranged at a location upstream of the heater device 31 on the transport passage 13, while the discharge roller means 37 is arranged at a location downstream of the same.

The feed roller means 36 is comprised of a feed driven roller 36*a* positioned above and a feed drive roller 36*b* positioned below, the two rollers 36*a*, 36*b* being opposed to each other via the transport passage 13. The feed drive roller 36*b* is connected to the feed motor 38, for driving the feed driven roller 36*a* for rotation. The feed driven roller 36*a* is a free roller urged toward the feed drive roller 36*b* by a spring, not shown. The print medium A brought to the feed roller means 36 is sandwiched between the feed driven roller 36*a* and the feed drive roller 36*b* and advanced as the feed driven roller 36*a* rotates in accordance with rotation of the feed drive roller 36*b*.

Similarly, the discharge roller means 37 is comprised of a discharge driven roller 37*a* positioned above and a discharge drive roller 37*b* positioned below, the two rollers 37*a*, 37*b* being opposed to each other via the transport passage 13. The discharge drive roller 37*b* is connected to the discharge motor 39, for driving the discharge driven roller 37*a* for rotation. The discharge driven roller 37*a* is a free roller urged toward the discharge drive roller 37*b* by a spring, not shown. The print medium A brought to the discharge roller means 37 is sandwiched between the discharge driven roller 37*a* and the discharge drive roller 37*b* and discharged out of the casing 2 as the discharge driven roller 37*a* rotates in accordance with rotation of the discharge drive roller 37*b*. Similarly to the motors 28, 29 in the printer block 3, the feed motor 38 and the discharge motor 39 may be implemented by a single motor.

The heater-side controller 34 controls the heater device 31 and the heater-block conveyor device 33, based on results of detection by the printer-side controller 15. The heater-side controller 34 causes the print medium A to be properly subjected to heat treatment while being fed or advanced. More specifically, the heater-side controller 34 determines the heating temperature and carrying speed of the print medium A in the heater block 4, based on attribute information (including the kind of the medium body AM and the material of the substrate layer 101) of the print medium A detected by the printer-side controller 15. It should be noted that actually, the heater-side controller 34 and the printer-side controller 15 are formed on a single circuit board.

To form an image on the print medium A by the image-forming apparatus 1 constructed as above, first, after the print medium A is supplied to the feeder, the separator AS is peeled off the print medium A to make the same ready for being brought to the printing device 11 with its ink image-receiving sheet AC facing toward the printing device 11. Then, the print medium A is fed to the printing device 11 to allow the same to effect image printing on the ink image-receiving sheet AC by using sublimable dye ink, whereby ink droplets are impregnated into the ink image-receiving sheet AC and held in the same.

Figure 4A:
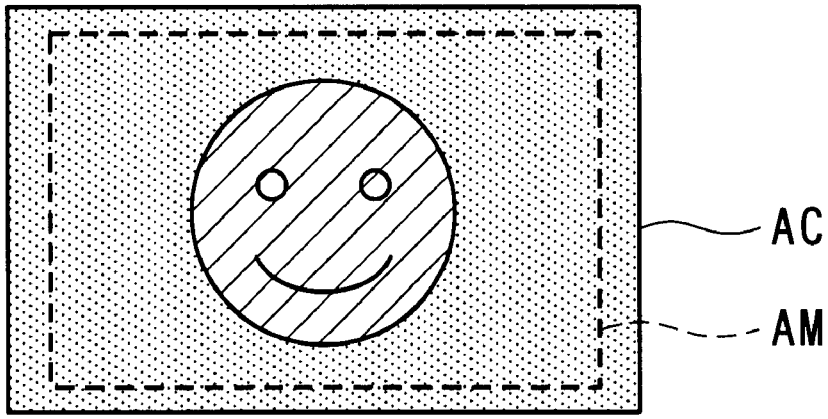
FIGS. 4A to 4C are plan views of a print medium, schematically illustrating a process of an image being formed on the print medium.
Figure 4B:
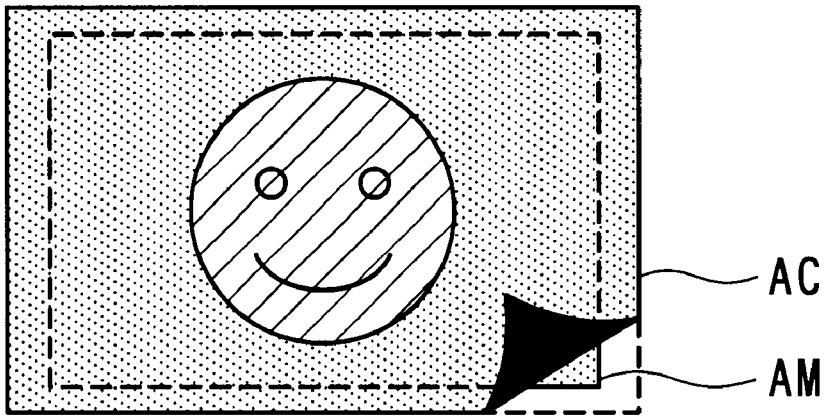
Figure 4C:
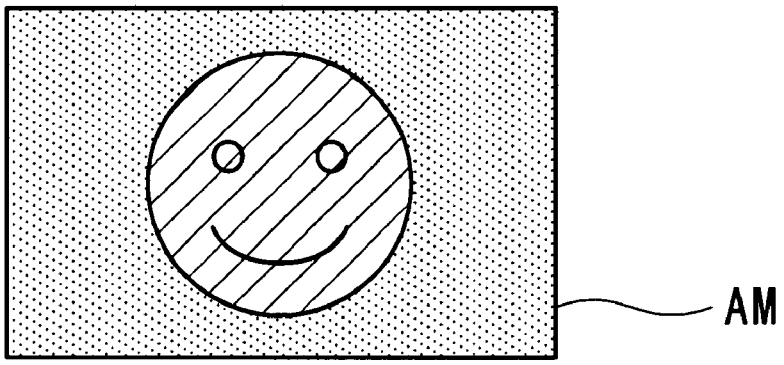

The print medium A printed with the image is sent to the heater device 13 for heat treatment. When the print medium A is heated, the sublimable dye ink held in the ink image-receiving sheet AC penetrates into the ink-fixing layer 102 to be subjected to color development, whereby the image is fixed in the ink-fixing layer 102. Thereafter, the ink image-receiving sheet AC is peeled off and thereby removed from the medium body AM to expose the ink-fixing layer 102, whereby the medium body AM or card having the image formed on the whole surface thereof from edge to edge is produced (see FIGS. 4A to 4C).

According to the image-forming method described above, the ink image-receiving sheet is formed to have a larger size than that of the medium body, so that even when printing is effected up to an area of the ink image-receiving sheet slightly beyond the surface of the medium body so as to form an image on the whole surface of the medium body from edge to edge, it is possible to prevent ink droplets from being directly deposited on the end faces of the medium body. Therefore, the image can be reliably formed on the whole surface of the medium body from edge end to edge end without staining the end faces of the medium body. In short, so-called edge-to-edge printing can be properly carried out.

It should be noted that the print medium A may be constructed to have the same laminate structures on the respective opposite sides thereof. More specifically, the print medium A may be formed by laminating ink image-receiving sheets AC on the respective upper and lower surfaces of the substrate layer 101 of the medium body AM, and then affixing separators AS to the respective ink image-receiving sheets AC as uppermost and lowermost layers for protecting the surfaces of the ink image-receiving sheets AC, so as to allow images to be formed on the both surfaces of the medium body AM. In this case, after the separators AS are each peeled off, printing is effected on each of the ink image-receiving sheets AC, and then the ink image-receiving sheets AC are removed for exposure of the upper and lower surfaces of the medium body AM. Thus, the medium body AM having the both surfaces printed with respective images is produced.

Figure 5A:
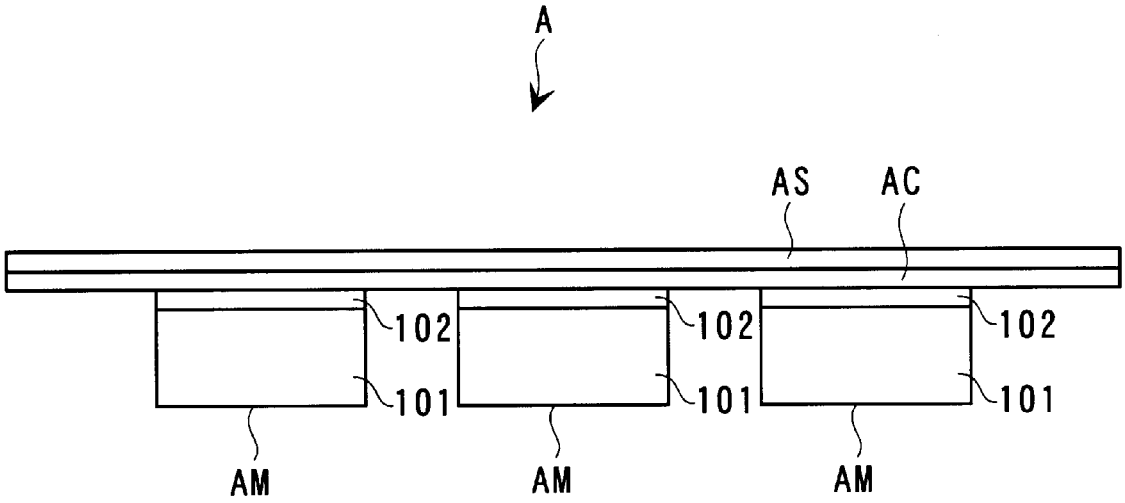
FIG. 5A is a cross-sectional view of a variation of the print medium for use in the image-forming method according to the first embodiment.

Further, as shown in FIG. 5A, a print medium A may be formed of a plurality of medium bodies continuously laminated with an ink image-receiving sheet AC. More specifically, a plurality of medium bodies AM may be laminated with a very large or long single ink image-receiving sheet AC in a manner such that the surfaces thereof are covered by the ink image-receiving sheet AC, to thereby form a print medium A. In this case, there are provided two types of print media, i.e. a separable type shown in FIG. 5A and a punch-out type shown in FIG. 5B.

The separable type shown FIG. 5A has a plurality of medium bodies AM affixed to a single ink image-receiving sheet AC at predetermined space intervals. In other words, the plurality of medium bodies AM are individually held by the single ink image-receiving sheet AC. This makes it possible to collectively supply the plurality of medium bodies AM as a single unit. To form images on the respective medium bodies AM, each medium body AM for printing may be separated from the ink image-receiving sheet AC before being brought to the printer device 11, or alternatively, may be brought to the printer device 11 as it is.

Figure 5B:
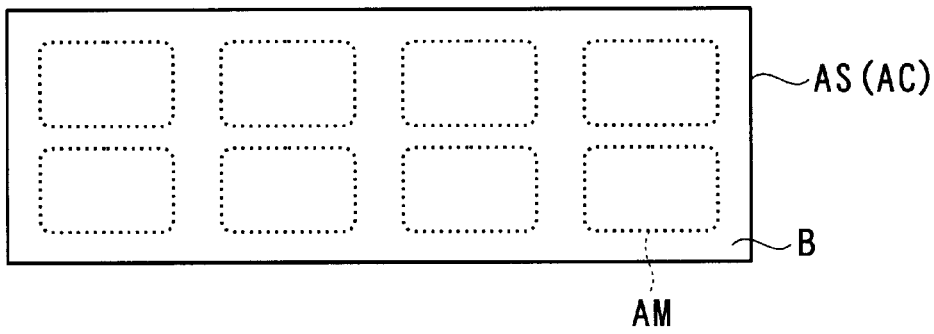
FIG. 5B is a plan view of another variation of the print medium for use in the image-forming method according to the first embodiment.

The punch-out type shown in FIG. 5B has a plurality of medium bodies AM integrally formed with each other in a state each defined by cutting lines for use in separating the medium body AM, and the medium bodies AM are affixed to an ink image-receiving sheet AC. More specifically, the plurality of medium bodies AM are formed on a base plate B such that each of the medium bodies AM can be easily separated from the base plate B, and each medium body can be separated (punched out) from the other medium bodies AM along cutting lines defining the medium body AM. This type of print medium A is advantageous particularly in a batch process carried out by collectively bringing a plurality of medium bodies AM to the printer device 11 and the heater device 31 for printing and heating. It should be noted that so long as the medium bodies AM can be held by the ink image-receiving sheet AC in a state affixed thereto, the medium bodies AM may be provided in a state completely separated from the ink image-receiving sheet AC, together with the base plate B.

The print medium A may be brought to the printer device 11 while having a separator AS thereof peeled off by being taken up into a roll. Further, although the print medium A is provided with the image-receiving sheet AC affixed to the medium bodies AM, it is not absolutely required to configure the print medium A such that the image-receiving sheet AC is affixed to the medium bodies AM so long as the image-receiving sheet AC is appropriately overlaid upon the medium bodies AM. It should be noted that for adhesion between the image-receiving sheet AC and each medium body AM, it is only required to give appropriate stickiness to either one of them.

Figure 6A:
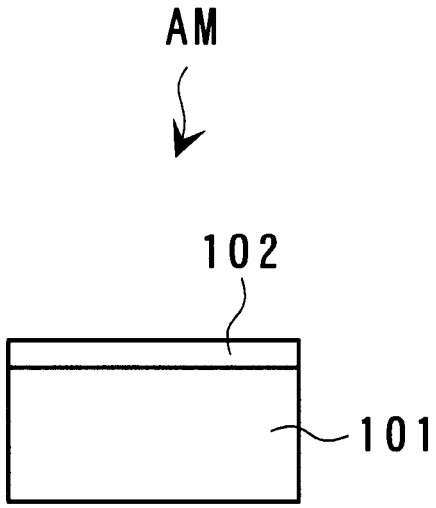
FIG. 6A is a cross-sectional view of a medium body according to a second embodiment of the invention.
Figure 6B:
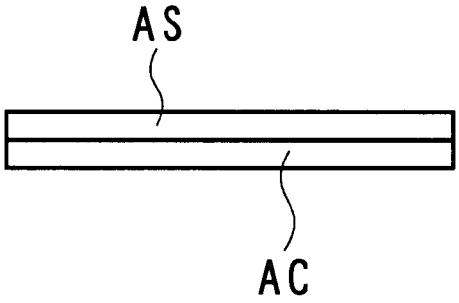
FIG. 6B is a cross-sectional view of an ink image-receiving sheet according to the second embodiment.
Figure 7:
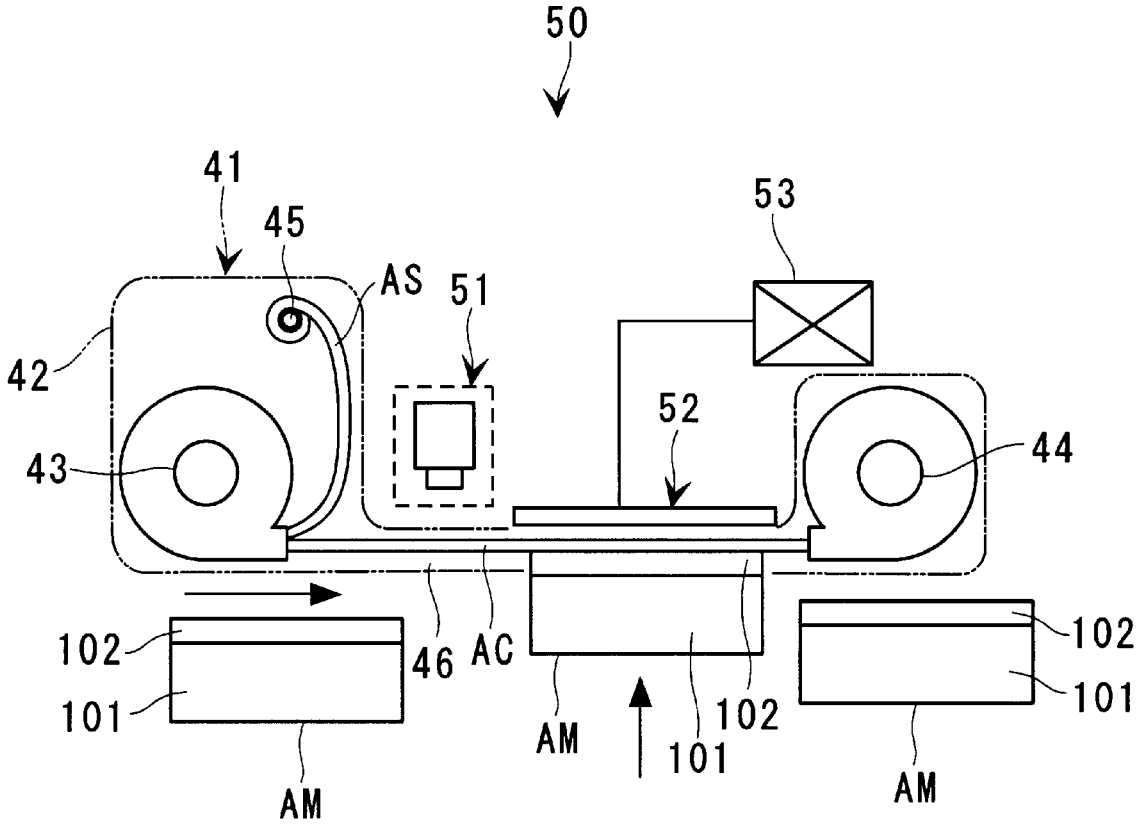
FIG. 7 is a cross-sectional view schematically showing the arrangement of an image-forming apparatus according to the second embodiment.

Next, a second embodiment of the present invention will be described with reference to FIGS. 6A, 6B and 7. FIGS. 6A, 6B show the structure of a print medium according to the second embodiment, while FIG. 7 schematically shows essential parts and elements of an image-forming apparatus according to the second embodiment. In the present embodiment, a print medium is used which is formed comprised of a medium body AM and an ink image-receiving sheet AC, separate from each other, and after an image is printed on the ink image-receiving sheet AC, the printed portion of the ink image-receiving sheet AC is overlaid to the surface of the medium body AM. The resulting print medium is subjected to heat treatment whereby the image is formed on the surface of the medium body AM.

The medium body AM, which is identical in construction to the medium body AM of the first embodiment, is comprised of a substrate layer 101 and an ink-fixing layer 102 laminated on the surface of the substrate layer 101. The medium body AM forms the body of a card. Further, similarly to the first embodiment, a fluorine film layer 103 may be laminated on the surface of the ink-fixing layer 102.

The ink image-receiving sheet AC, which is generally identical in construction to the ink image-receiving sheet AC of the first embodiment, is formed of a hydrophilic resin material capable of temporarily holding the sublimable dye ink directly ejected thereon for printing, and has a surface width slightly larger than that of the medium body AM. Further, a separator AS is affixed to the image-receiving surface of the ink image-receiving sheet AC. The separator AS is also identical in construction to the separator AS of the first embodiment. The separator AS protects the surface of the ink image-receiving sheet AC. The ink image-receiving sheet AC is contained in a sheet cartridge 41 in the state laminated with the separator AS.

The sheet cartridge 41 has an outer shell formed by a single cartridge casing 42 in which are received a supply reel 43 for rolling out the ink image-receiving sheet AC, a sheet take-up reel 44 for taking up a used portion of the ink image-receiving sheet AC, and a separator take-up reel 45 for taking up the separator AS. The supply reel 43 can perform free rotation, while the sheet take-up reel 44 and the separator take-up reel 45 are each mounted on a drive shaft, not shown, such that they can be driven thereon for rotation. Further, within the sheet cartridge 41, there is formed a sheet traveling passage 46 extending from the supply reel 43 to the sheet take-up reel 44.

Around the supply reel 43 is wound the unused ink image-receiving sheet AC in the form of a roll with the separator AS inside. More specifically, the ink image-receiving sheet AC is wound around the supply reel 43 in a state in which rigidity is imparted to the sheet AC by the separator AS and one portion of the ink image-receiving sheet AC is prevented by the separator AS from adhering to another portion of the ink image-receiving sheet AC.

The sheet take-up reel 44 causes the ink image-receiving sheet AC laminated with the separator AS to rolled out from the supply reel 43, and takes up the used ink image-receiving sheet AC fed along the sheet traveling passage 46. During this process, the separator AS is peeled off the ink image-receiving sheet AC before printing is effected on the ink image-receiving sheet AC, and taken up by the separator take-up reel 45.

Next, the image-forming apparatus according to the second embodiment will be described. The image-forming apparatus 50 has the sheet cartridge 41 mounted therein, and performs printing on the ink image-receiving sheet AC rolled out from the supply reel 43. Then, the printed portion of the ink image-receiving sheet AC is overlaid to the medium body AM and subjected to heat treatment in this state, followed by the heated ink image-receiving sheet AC being removed from the medium body AM.

As shown in FIG. 7, the image-forming apparatus 50 includes peeling means (45) arranged above the sheet traveling passage 46, for peeling the separator AS off the ink image-receiving sheet AC being fed along the sheet traveling passage 46 from the supply reel 43, a printer device 51 for carrying out printing on the ink image-receiving sheet AC, and a heater device 52 for applying heat treatment to the ink image-receiving sheet AC. Further, the apparatus 50 includes a conveyor device, not shown, arranged below the sheet traveling passage 46, for carrying the medium body AM. In the figure, a casing of the apparatus 50 is not shown.

The peeling means (45) is formed by the separator take-up reel 45 interposed between the supply reel 43 and the printer device 51. The printer device 51 is generally identical in construction to the printer device 11 of the first embodiment. More specifically, the printer device 51 is comprised of a head unit, a carriage motor as a drive source, and a reciprocating mechanism which receives torque from the carriage motor to reciprocate the head unit. The head unit is comprised of an ink jet head having a plurality of nozzles formed in an underside surface thereof, an ink cartridge which supplies sublimable dye ink to the ink jet head, and a carriage carrying the ink jet head and the ink cartridge.

In the present embodiment, similarly to the first embodiment, a carriage is caused to reciprocate by the reciprocating mechanism, and during the reciprocating motion of the carriage, ink droplets are properly ejected from the ink jet head, whereby printing is effected on the ink image-receiving sheet AC. More specifically, in the present embodiment, while the ink image-receiving sheet AC passing under the head unit is intermittently fed along the sheet traveling passage 46, the head unit performs reciprocating motion in a direction orthogonal to the direction of feeding of the ink image-receiving sheet AC, whereby printing is performed on the ink image-receiving sheet AC. It should be noted that the printing is effected over an area of the ink image-receiving sheet AC which is slightly larger than a surface area of the medium body AM.

The heater device 52 is generally identical in construction to the heater device 31 of the first embodiment. More specifically, the heater device 52 is formed by a so-called non-contact heater which can face the ink image-receiving sheet AC being fed, in a spaced non-contacting fashion. The heater device 52 is arranged above the sheet traveling passage 46 and connected to a heater-side controller 53, which controls the heating temperature of the heater device 52.

The conveyor device, not shown, is comprised of a transfer mechanism for transferring the medium body AM and an overlay mechanism for overlaying the medium body AM to the ink image-receiving sheet AC. The medium body AM is transferred by the transfer mechanism to the heater device 52, where the surface of the medium body AM is overlaid to an opposite surface of the ink image-receiving sheet AC to the image-forming surface of the same by the overlay mechanism.

Description will now be given of a process of forming an image on a medium body AM by the use of the image-forming apparatus constructed above. The ink image-receiving sheet AC is fed with its image-receiving surface facing toward the printer device 51 while having the separator AS on the surface thereof being peeled off by the peeling means (45). The image is printed on the ink image-receiving sheet AC by using sublimable dye ink, such that the printing is effected on an area of the ink image-receiving sheet AC which is slightly larger than the size of the medium body AM. More specifically, image printing is carried out indirectly on the medium body AM, whereby the ink image-receiving sheet AC is impregnated with ink droplets.

The printed portion of the ink image-receiving sheet AC is fed to the heater device 52 by rotation of the sheet take-up reel 44. On the other hand, the medium body AM is fed to the heater device 52 by the transfer mechanism. During this operation, the ink image-receiving sheet AC is fed to the heater device 52 with its image-receiving surface facing toward the heater device 52 above and the opposite surface thereto facing toward the medium body AM below. The feed of the image-receiving sheet AC and the medium body AM is stopped when the printed portion of the image-receiving sheet AC and the medium body AM reach a position opposed to the heater device 52, and the medium body AM is aligned on the printed portion of the image-receiving sheet AC via the overlay mechanism and then overlaid to the same. When heat treatment is carried out by the heater device 52 in this state, the sublimable dye ink held in the image-receiving sheet AC penetrates into the surface layer, i.e. the ink-fixing layer 102, of the medium body AM to be subjected to color development, whereby the image is fixed in the ink-fixing layer 102.

After having been subjected to the heat treatment, the ink image-receiving sheet AC is fed along the sheet traveling passage 46 while being separated from the surface of the medium body AM, to be taken up by the sheet take-up reel 44. When the ink image-receiving sheet AC is removed from the surface of the medium body AM, the ink-fixing layer 102 of the medium body AM is exposed. Thus, the medium body AM or card having the image formed on the whole surface thereof from edge to edge is produced.

According to the image-forming method described above, image printing (transfer) is effected on the medium body AM via the ink image-receiving sheet AC as a separate member, so that ink droplets are not directly deposited on the medium body AM. Further, the ink image-receiving sheet AC is formed to have a larger size than that of the medium body AM, so that even when printing is carried out up to an area of the ink image-receiving sheet AC slightly beyond the surface of the medium body AM, it is possible to reliably form an image on the whole surface of the medium body laterally and longitudinally in a edge-to-edge fashion.

It should be noted that the medium body AM may be constructed to have the same laminate structures on the respective opposite sides thereof so as to permit double-sided printing in which after an image is formed on one side of the medium body AM, another image is formed on the other side of the same.

Further, the print medium may be configured such that the ink image-receiving sheet AC has no separator AS on the surface thereof and the ink image-receiving sheet AC itself has rigidity and is capable of preventing one portion thereof from adhering to another thereof when it is wound into a roll. More specifically, the ink image-receiving sheet AC may be formed of a sheet substrate layer and an ink image-receiving layer laminated (coated) on the sheet substrate layer. In this case, the ink image-receiving sheet AC is wound into a roll with the sheet substrate layer inside. Although in the above embodiment, the ink image-receiving sheet AC in the form of a roll is employed, an ink image-receiving sheet AC may be in the form of a cut sheet.

Figure 8:
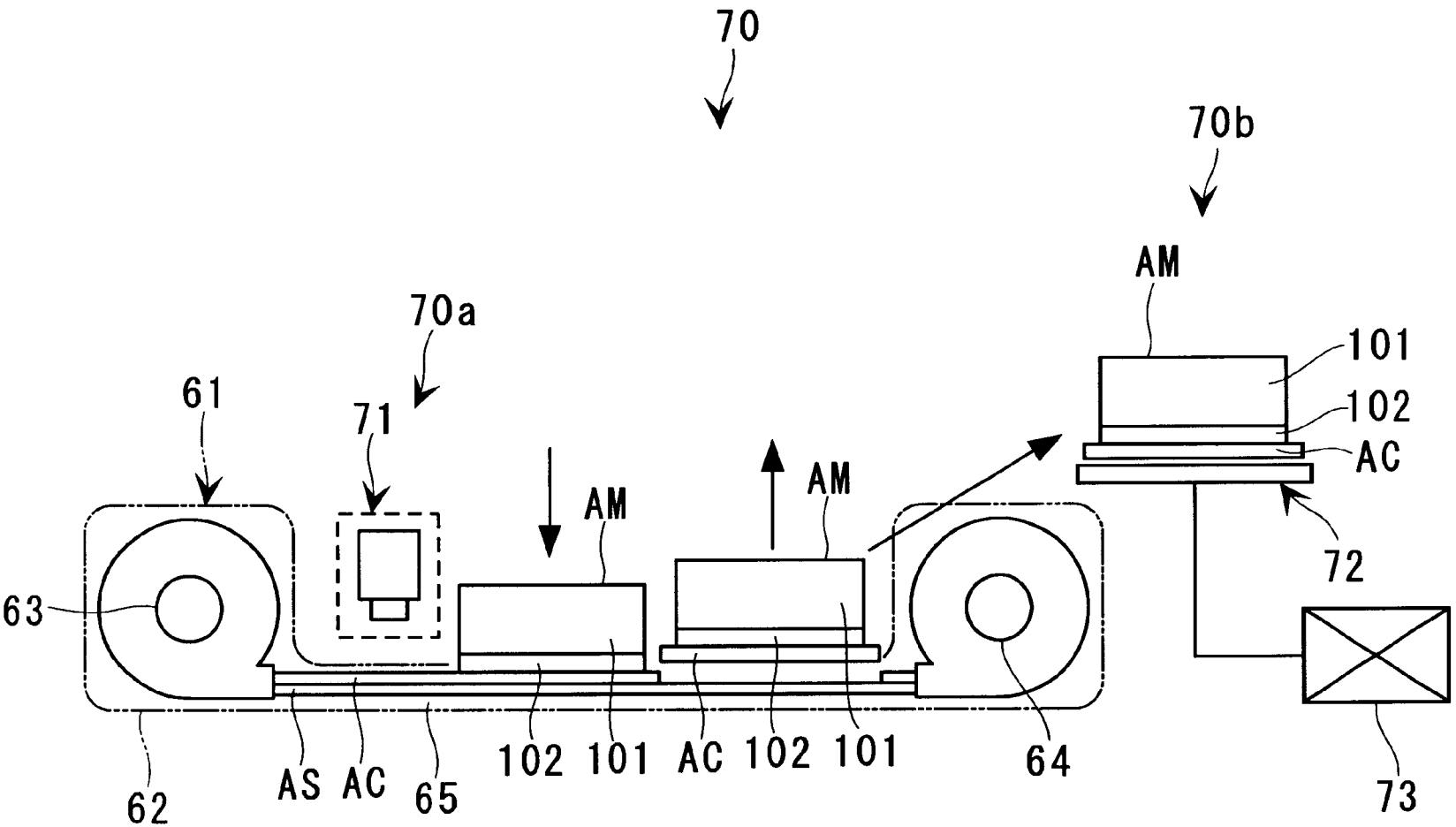
FIG. 8 is a cross-sectional view schematically showing the arrangement of an image-forming apparatus according to a third embodiment of the invention.

Next, a third embodiment of the invention will be described with reference to FIG. 8. The present embodiment is a variation from the second embodiment. More specifically, in the third embodiment, an ink image-receiving sheet AC and a separator AS are positioned upside down in their positional relationship, in comparison with the second embodiment. Accordingly, the present embodiment is distinguished from the second embodiment by the construction of a sheet cartridge and the like. In the following, description of portions similar to those of the second embodiment will be omitted.

The ink image-receiving sheet AC, which is generally identical in construction to the ink image-receiving sheet AC of the first embodiment, is formed of a hydrophilic resin material which is capable of temporarily holding sublimable dye ink directly ejected thereon for printing and made easy to peel by heating. Further, the ink image-receiving sheet AC is formed to have a size larger than that of a medium body AM. That is, the ink image-receiving sheet AC has a surface width slightly larger than that of the medium body AM.

Further, the ink image-receiving sheet AC has the separator AS affixed to an opposite surface thereof to an image-forming surface thereof. The separator AS is also identical in construction to the separator AS of the first embodiment, and imparts rigidity to the ink image-receiving sheet AC. The ink image-receiving sheet AC is contained in a sheet cartridge 61 in the state laminated with the separator AS.

The sheet cartridge 61 is also generally identical in construction to the sheet cartridge 41 of the second embodiment, but the present embodiment is distinguished from the second embodiment in that the separator AS is taken up at a downstream location within a cartridge casing 62. In the present embodiment, the sheet cartridge 61 having an outer shell formed by the single cartridge casing 62 contains a supply reel 63 for rolling out the ink image-receiving sheet AC, and a separator take-up reel 64 for taking up the separator AS. The supply reel 63 can perform free rotation, while the separator take-up reel 64 can be driven for rotation. Further, within the sheet cartridge 61, there is formed a sheet traveling passage 65 extending from the supply reel 63 to the separator take-up reel 64.

The unused ink image-receiving sheet AC with the separator AS affixed to an outer surface thereof is wound around the supply reel 63 into a roll. More specifically, the ink image-receiving sheet AC is wound around the supply reel 63 in a state of rigidity being imparted thereto by the separator AS and one portion thereof being prevented from adhering to another by the same, such that the ink image-receiving sheet AC can be rolled out. The supply reel 63 is arranged at a location upstream of a printer device 71. On the other hand, the separator take-up reel 64 is arranged at a location downstream of the printer device 71. The separator take-up reel 64 is driven by a drive shaft, not shown, for rotation to roll out the separator AS with the ink image-receiving sheet AC affixed thereto from the supply reel 63 and to take up the separator AS at the same time.

More specifically, the ink image-receiving sheet AC is rolled out from the supply reel 63 by rotation of the separator take-up reel 64 and fed to the printer device 71 in a manner guided along the sheet traveling passage 65 by the separator AS affixed thereto. Then, a medium body AM is overlaid upon a printed portion of the ink image-receiving sheet AC, and the remainder of the ink image-receiving sheet AC is taken up together with the separator AS by the separator take-up reel 64.

Next, brief description will be given of an image-forming apparatus according to the third embodiment. As shown in FIG. 8, the image-forming apparatus 70 is comprised of a printer block 70*a* in which the sheet cartridge 61 is mounted, and which performs printing on the ink image-receiving sheet AC and overlays a medium body AM to the printed portion of the ink image-receiving sheet AC, and a heater block 70*b* for heating the medium body AM after the overlay process. In the figure, an apparatus casing is not shown.

The printer block 70*a* includes the printer device 71 similar to the printer device 51 of the second embodiment, and has the sheet cartridge 61 mounted therein such that the supply reel 63 is arranged on the sheet traveling passage 65 at a location upstream of the printer device 71, and the separator take-up reel 64 arranged at a location downstream of the printer device 71. The printer device 71 prints an image on the image-receiving surface, i.e. the upper surface of the ink image-receiving sheet AC protected by the separator AS from below, by using sublimable dye ink. Similarly to the second embodiment, the printing is effected on an area of the ink image-receiving sheet AC slightly larger than the surface area of the medium body AM.

Further, the printer block 70*a* includes a feed means, not shown, for feeding a medium body AM, an overlay means, not shown, for overlaying the medium body AM to the ink image-receiving sheet AC, a separation means, not shown, for separating the medium body AM overlaid to the ink image-receiving sheet AC from the separator AS together with the ink image-receiving sheet AC, and a transfer means, not shown, for transferring the separated medium body AM to the heater block 70*b*. The feed means feeds the medium body AM such that the ink-fixing layer 102 of the medium body AM can face toward the image-receiving surface of the ink image-receiving sheet AC.

The overlay means aligns and overlays the medium body AM to an ink-holding portion of the image-receiving surface of the ink image-receiving sheet AC, which is formed by sublimable dye ink impregnated into the image-receiving surface and held in the same. More specifically, the medium body AM is properly overlaid to the ink-holding portion of the ink image-receiving sheet AC in intimate contact with the same by the overlay means, and firmly affixed to the ink image-receiving sheet AC so as to prevent separation of the medium body AM from the ink image-receiving sheet AC. It should be noted that even if slight displacement occurs between the medium body AM and the ink-holding portion at this time, since the printed portion of the ink image-receiving sheet AC is larger in area than the medium body AM, the surface of the medium body AM can be overlaid with the ink-holding portion from edge to edge.

The separation means properly separates the medium body AM overlaid to the ink image-receiving sheet AC from the separator AS. More specifically, the separation means severs non-printed portions of the ink image-receiving sheet AC from respective opposite sides of the medium body AM overlaid to the printed portion of the ink image-receiving sheet AC, in the sheet-feeding direction, without cutting the separator AS, by linearly cutting along the respective boundaries between the printed portion and the non-printed portions, whereby the medium body AM is separated from the separator AS. In this case, the ink image-receiving sheet AC is cut such that the portion thereof affixed to the medium body AM can have a larger surface width than that of the medium body AM. It should be noted that the medium body AM may be separated from the separator AS by being peeled off along cutting lines formed on the ink image-receiving sheet AC in advance, instead of being cut as described above.

The transfer means transfers the separated medium body AM to the cutter block 70*b* and brings the ink image-receiving sheet AC affixed to the medium body AM to a heater device 72. On the other hand, the separator AS separated from the medium body AM is taken up, together with part of the remainder of the ink image-receiving sheet AC, by the separator take-up reel 64 in accordance with rotation of the same. Preferably, the overlay means, the separation means and the transfer means are implemented by a unitary device.

The heater block 70*b* includes a heater device 72 similar to the heater device 52 of the second embodiment. More specifically, the heater device 72 is formed by a so-called non-contact heater which can face the ink image-receiving sheet AC on the medium body AM delivered after the separation, in a spaced non-contacting fashion. The heater device 72 is connected to a heater-side controller 73, which controls the heating temperature of the heater device 72.

Description will now be given of a process of forming an image on a medium body AM by the use of the image-forming apparatus 70 constructed as above. The ink image-receiving sheet AC is fed, with its image-receiving surface or upper surface facing toward the printer device 71, in accordance with feed of the separator AS affixed to the lower surface thereof. The image is printed on the ink image-receiving sheet AC by using sublimable dye ink, such that the printing is effected on an area of the ink image-receiving sheet AC which is slightly larger than the size of the medium body AM.

After the printing of the image is completed, the ink image-receiving sheet AC is further sent forward by rotation of the separator take-up reel 64, and the medium body AM is overlaid to the ink-holding portion of the ink image-receiving sheet AC by the overlay means. After having been overlaid with the medium body AM, the ink image-receiving sheet AC is separated from the separator AS together with the medium body AM by the separation means, in a state of being laminated to the ink-fixing layer 102 of the medium body AM, and the separator AS separated from the ink image-receiving sheet AC is taken up by the separator take-up reel 64. The medium body AM is brought to the heater device 72 by the transfer means. When the medium body AM is heated by the heater device 72, the sublimable dye ink held in the image-receiving sheet AC penetrates into the surface or ink-fixing layer 102 of the medium body AM to be subjected to color development, whereby the image is fixed in the ink-fixing layer 102.

The ink image-receiving sheet AC having been subjected to the heat treatment is easy to peel off the medium body AM. Therefore, when a user removes the ink image-receiving sheet AC from the surface of the medium body AM at this stage, the ink-fixing layer 102 is exposed, and the medium body AM or card having the image formed on the whole surface thereof from edge to edge is produced.

According to the image-forming method described above, since rigidity is imparted to the ink image-receiving sheet AC by the separator AS, it is possible to bring the ink image-receiving sheet AC to a proper position facing the printer device 71 as well as to properly overlay the medium body AM to the ink image-receiving sheet AC.

It is preferred that one of the medium body AM or the image-receiving sheet AC has an appropriate stickiness on a surface thereof for contact with the other. This stickiness enables them to be properly overlaid to each other and facilitates separation of the image-receiving sheet AC from the separator AS together with the medium body AM.

Figure 9:
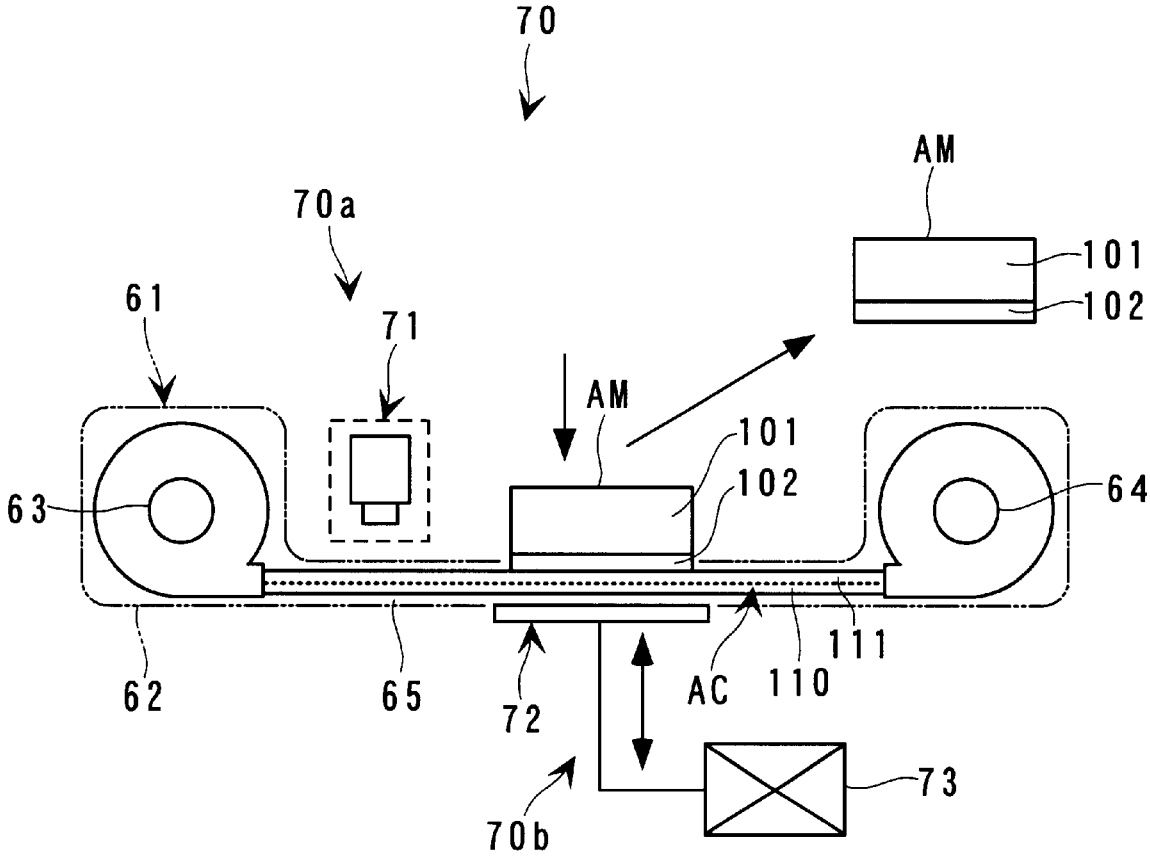
FIG. 9 is a cross-sectional view schematically showing the arrangement of an image-forming apparatus according to a fourth embodiment of the invention.

Next, a fourth embodiment of the invention will be described with reference to FIG. 9. The present embodiment is a variation from the third embodiment. More specifically, in the fourth embodiment, an ink image-receiving sheet AC is constructed such that it is capable of maintaining its own rigidity without being provided with a separator AS, and preventing one portion thereof from sticking to another in a state wound into a roll, and printing and heat treatment are carried out in the course of travel of the ink image-receiving sheet AC being taken up. Therefore, the present embodiment is distinguished from the third embodiment by points described below.

Also in the present embodiment, the ink image-receiving sheet AC is comprised of a sheet substrate layer 110 having rigidity and an ink image-receiving layer 111 laminated (coated) on the sheet substrate layer 110, and wound into a roll with the sheet substrate layer 110 as an outer layer. Accordingly, the ink image-receiving sheet AC is taken up within a cartridge casing 62 of a sheet cartridge 61. The sheet cartridge 61 having an outer shell formed by the single cartridge casing 62 contains a supply reel 63 for rolling out the ink image-receiving sheet AC and a take-up reel 64 for taking up the ink image-receiving sheet AC. Further, within the sheet cartridge 61, there is formed a sheet traveling passage 65 extending from the supply reel 63 to the take-up reel 64.

The image-forming apparatus 70 according to the fourth embodiment is comprised of a printer block 70*a* and a heater block 70*b* similar to those of the third embodiment, the heater block 70*b* facing the sheet traveling passage 65 within the sheet cartridge 61. More specifically, a printer device 71 is arranged on an upstream side of the sheet traveling passage 65, and a heater device 72 on a downstream side of the same, such that the printer device 71 can face the ink-receiving layer 111 of the ink image-receiving sheet AC, while the heater device 72 can face the sheet substrate layer 110. Further, the image-forming apparatus 70 of the present embodiment includes feed means, overlay means and separation means generally similar to those of the third embodiment.

The heater device 72 may be implemented by a non-contact heater similarly to the above embodiments. However, in the present embodiment, it is formed as a thermal presser (whose heat source may be electric power, light or any other thing available). More specifically, the thermal presser carries out heat treatment by bringing the ink image-receiving sheet AC into pressure contact with the medium body AM from the sheet substrate layer side and at the same time heating them. The thermal presser may take a plurality of forms, not shown. For example, it is formed by a pair of rollers which rotate at a constant speed to feed the ink image-receiving sheet AC and the medium body AM simultaneously while holding the same in a sandwiching manner, with at least the ink image-receiving sheet-side roller functioning as a heating roller. Alternatively, it may be formed by a thermal pressing mechanism which heats the ink image-receiving sheet AC and the medium body AM while sandwiching or pressing them therein. The thermal presser may be also configured to cooperate with the overlay means.

Brief description will now be given of a process of forming an image on a medium body AM by the use of the image-forming apparatus 70 of the present embodiment. The ink image-receiving sheet AC which has been rolled out from the supply reel 63 and subjected to printing has the ink-holding portion thereof overlaid with the medium body AM from the ink image-receiving layer side by the overlay means, and is heated from the sheet substrate layer side by the heater device 72. As a result, sublimable dye ink held in the image-receiving sheet AC penetrates into a surface or ink-fixing layer 102 of the medium body AM for color development.

The medium body AM having been subjected to the heat treatment is separated from the ink image-receiving sheet AC and supplied to the user as a card printed with the image. On the other hand, the ink image-receiving sheet AC separated from the medium body AM is taken up by the take-up reel 64. Consequently, the image-forming method of the present embodiment also makes it possible to reliably form an image on the whole surface of the medium body AM laterally and longitudinally in an edge-to-edge fashion, and further to transfer the image to the medium body AM efficiently and reliably by the thermal pressing operation.

Figure 10:
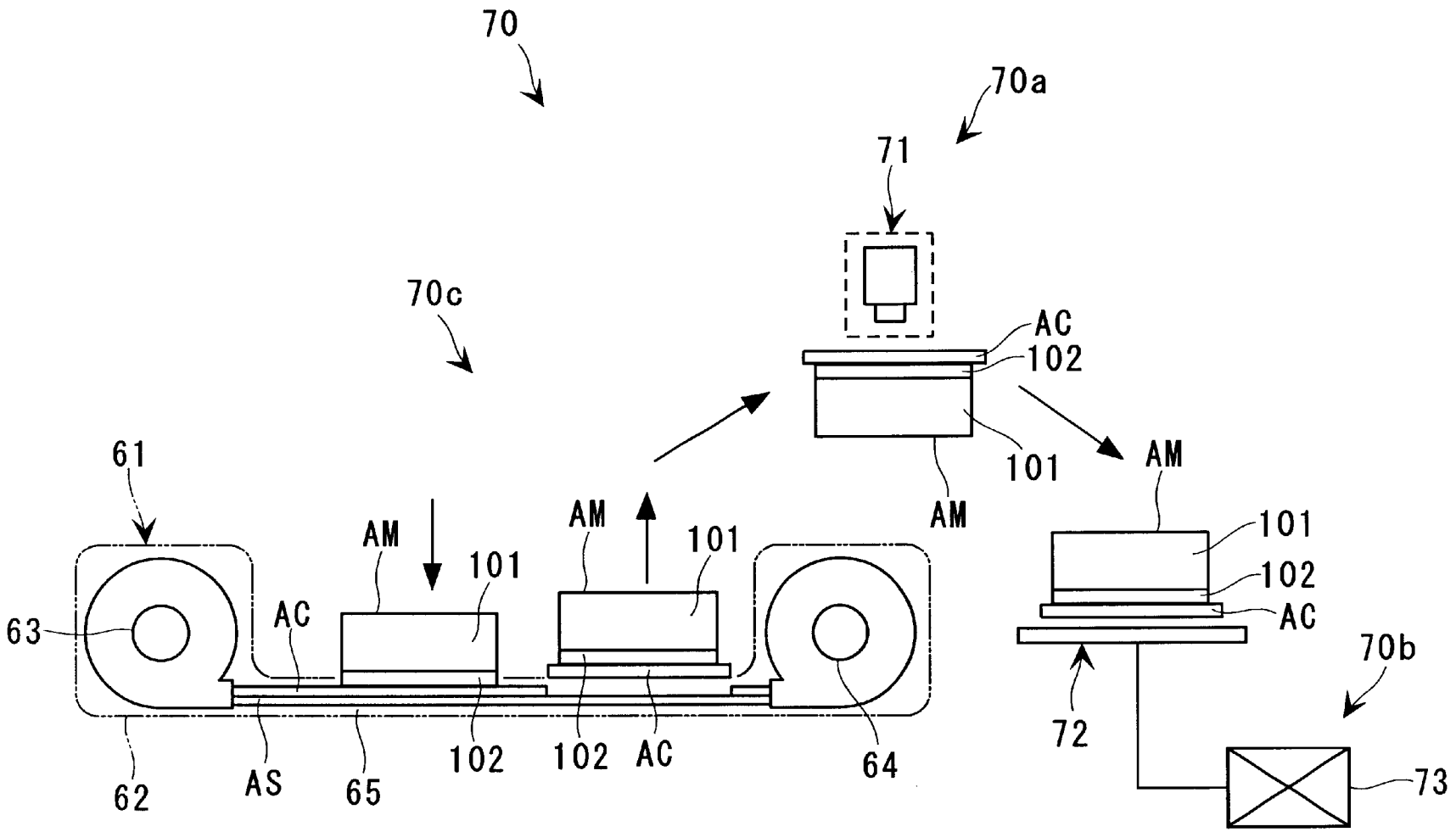
FIG. 10 is a cross-sectional view schematically showing the arrangement of an image-forming apparatus according to a fifth embodiment of the invention.

Next, a fifth embodiment of the invention will be described with reference to FIG. 10. The present embodiment is a variation from the third embodiment, and similar to the third embodiment in that the identical sheet cartridge 61 is employed. However, the fifth embodiment is partially different from the third embodiment in the order of processing steps carried out by devices and means. More specifically, in the present embodiment, a medium body AM is overlaid (laminated) on an ink image-receiving sheet AC, and then the medium body AM laminated with the ink image-receiving sheet AC is separated from a separator AS. Thereafter, printing, heating and removal of the ink image-receiving sheet AC are sequentially carried out.

An image-forming apparatus 70 according to the fifth embodiment is comprised of an overlay/separation block 70*c* in which the sheet cartridge 61 is mounted, and which overlays a medium body AM to the ink image-receiving sheet AC and then separates the medium body AM laminated with the ink image-receiving sheet AC from the separator AS, a printer block 70*a* including a printer device 71 for printing on the ink image-receiving sheet AC overlaid to the medium body AM, and a heater block 70*b* including a heater device 72 for heating the printed medium body AM. In the figure, an apparatus casing is not shown.

The overlay/separation block 70*c* is comprised of a feed means for feeding a medium body AM, an overlay means for overlaying the medium body AM to the ink image-receiving sheet AC, a separation means for separating the medium body AM laminated with the ink image-receiving sheet AC from the separator AS, and a transfer means for transferring the separated medium body AM to the printer block 70*a*, which are similar to those described in the third embodiment. In the present embodiment, the overlay means laminates the medium body AM to the ink image-receiving sheet AC in a non-printed state by an adhesive coated on one of the ink image-receiving sheet AC and the medium body AM. On the other hand, the separation means separates the medium body AM from the separator AS together with the ink image-receiving sheet AC in a state in which the ink image-receiving sheet covers even end faces of the surface of the medium body AM. Preferably, the ink image-receiving sheet AC is formed with cutting lines.

Brief description will be given of a process of forming an image on a medium body AM by the use of the image-forming apparatus 70 of the present embodiment. The ink image-receiving sheet AC is rolled out from a supply reel 63 and advanced by rotation of a separator take-up reel 64, and the medium body AM is overlaid to the ink image-receiving sheet AC by the overlay means at a predetermined position. Then, the ink image-receiving sheet AC overlaid with the medium body AM is separated from the separator AS by the separation means together with the medium body AM in a state laminated to the ink-fixing layer 102 of the medium body AM. Thereafter, the separator AS which has been separated is taken up by the separator take-up reel 64, while the medium body AM is transferred to the printer device 71 by the transfer means.

When the medium body AM is brought to the printer device 71, image printing is carried out on the ink image-receiving sheet AC overlaid to the medium body AM, by the use of sublimable dye ink, and then the medium body AM is delivered to the heater device 72. The medium body AM laminated with the ink image-receiving sheet AC is heated by the heater device 72, whereby the image is fixed in the ink-fixing layer 102. When the user peels the ink image-receiving sheet AC off the medium body AM, the ink-fixing layer 102 is exposed, whereby the medium body AM or card having the image formed on the whole surface thereof from edge to edge is produced.

According to the present image-forming method, since the ink image-receiving sheet AC and the medium body AM are provided separately, and the medium body AM is overlaid to the ink image-receiving sheet AC before printing, it is possible to prevent displacement of the image on the ink image-receiving sheet AC with respect to the medium body AM. It should be noted that the overlay block 70*c* and the sheet cartridge 61 may be incorporated in the apparatus as the feeder in the first embodiment.

Further, in all the embodiments described above, it is preferred that the ink image-receiving sheet AC is formed of a material having a dark color (e.g. gray). This makes it possible to heat the whole surface of the ink image-receiving sheet AC uniformly in the heat treatment by a lamp light source, such as a halogen lamp, thereby forming a high-quality image without unevenness of printing on the surface of the medium body AM.

Further, although in the above embodiments, the respective printer devices perform printing by the ink jet printing method, this is not limitative, but the thermal printing method may be employed. In this case, even after thermal printing is performed, it is required to heat a print medium again for heat treatment.

It is further understood by those skilled in the art that the foregoing is a preferred embodiment of the invention, and that various changes and modifications may be made without departing from the spirit and scope thereof.

What is claimed is:

1. An image-forming method comprising the steps of:

printing an image on an ink image-receiving sheet by using a sublimable dye ink, thereby causing the sublimable dye ink to be held by the ink image-receiving sheet;

fixing the image in a surface of a medium body by heating the ink image-receiving sheet and the medium body overlaid to each other and thereby causing diffusion of the sublimable dye ink held in the ink image-receiving sheet in the surface of the medium body for color development; and removing the ink image-receiving sheet from the medium body having the image formed thereon;

wherein the ink image-receiving sheet is larger in size than the surface of the medium body;

wherein the ink image-receiving sheet and the medium body are formed separately; and wherein the image-forming method further includes the step of overlaying an ink-holding portion of the ink image-receiving sheet to the surface of the medium body and affixing the ink image-receiving sheet to the medium body.

2. An image-forming method according to claim 1, wherein the ink image-receiving sheet is rolled out from a roll thereof.

3. An image-forming method according to claim 2, wherein the ink image-receiving sheet has a separator affixed to an image-receiving surface thereof, for protection of the surface, and the image-forming method further including the step of peeling off the separator before the step of printing.

4. An image-forming method according to claim 2 or 3, wherein the ink image-receiving sheet removed from the medium body is taken up.

5. An image-forming method according to claim 2, wherein the ink image-forming sheet has a separator affixed to an opposite surface thereof to an image-receiving surface thereof, for protection of the image-receiving surface, and the image-forming method further including the step of separating the ink image-receiving sheet and the medium body overlaid and affixed to each other from the separator, after the step of overlaying and before the step of fixing the image.

6. An image-forming method according to claim 5, wherein the separator which has been separated from the ink image-receiving sheet and the medium body is taken up.

7. An image-forming method comprising the steps of:

printing an image on an ink image-receiving sheet by using a sublimable dye ink, thereby causing the sublimable dye ink to be held by the ink image-receiving sheet;

fixing the image in a surface of a medium body by heating the ink image-receiving sheet and the medium body overlaid to each other and thereby causing diffusion of the sublimable dye ink held in the ink image-receiving sheet in the surface of the medium body for color development; and removing the ink image-receiving sheet from the medium body having the image formed thereon, wherein the ink image-receiving sheet is larger in size than the surface of the medium body;

wherein the ink image-receiving sheet and the medium body are formed separately, the ink image-receiving sheet having a separator affixed to an image-receiving surface thereof; and wherein the image-forming method further includes the step of overlaying the medium body to an opposite surface of the ink image-receiving sheet to an image-receiving surface thereof and affixing the medium body to the ink image-receiving sheet, and the step of separating the ink image-receiving sheet and the medium body from the separator, before the step of printing.

8. An image-forming method according to claim 7, wherein the ink image-receiving sheet is rolled out from a roll thereof.

9. An image-forming method according to claim 8, wherein the separator which has been separated is taken up.

10. An image-forming method according to claim 7, wherein the ink image-receiving sheet is formed of a material which is made easy to peel off by heating.

11. An image-forming method according to claim 7, wherein the medium body has a fluorine film layer laminated on a surface thereof to which the ink image-receiving sheet is overlaid.

12. An image-forming method according to claim 7, wherein the medium body is a card.

13. An image-forming method according to claim 7, wherein the step of printing includes printing by an ink jet printing method.

14. A sheet cartridge for use in an image-forming method, the image-forming method including the steps of:

printing an image on an ink image-receiving sheet rolled out from a roll thereof, by using a sublimable dye ink, thereby causing the sublimable dye ink to be held by the ink image-receiving sheet, the ink image-receiving sheet being larger in size than a surface of a medium body and formed separately from the medium body, overlaying an ink-holding portion of the ink image-receiving sheet to the surface of the medium body and affixing the ink image-receiving sheet to the medium body;

fixing the image in the surface of the medium body by heating the ink image-receiving sheet and the medium body overlaid to each other and thereby causing diffusion of the sublimable dye ink held in the ink image-receiving sheet in the surface of the medium body for color development, removing the ink image-receiving sheet from the image body having the image formed thereon, and taking up the ink image-receiving sheet removed from the medium body, the sheet cartridge comprising:

said roll of the ink image-receiving sheet;

a supply reel for rolling out the ink image-receiving sheet therefrom;

a sheet take-up reel for taking up the ink image-receiving sheet rolled out; and a single cartridge casing accommodating said roll of the ink image-receiving sheet, said supply reel, and said sheet take-up reel.

15. A sheet cartridge for use in an image-forming method, the image-forming method including the steps of:

printing an image on an ink image-receiving sheet rolled out from a roll thereof, by using a sublimable dye ink, thereby causing the sublimable dye ink to be held by the ink image-receiving sheet, the ink image-receiving sheet being larger in size than a surface of a medium body, formed separately from the medium body, and having a separator affixed to an opposite surface thereof to an image-receiving surface thereof for receiving an image of the sublimable dye ink, overlaying an ink-holding portion of the ink image-receiving sheet to the surface of the medium body and affixing the ink image-receiving sheet to the medium body, separating the ink image-receiving sheet and the medium body overlaid and affixed to each other from the separator, fixing the image in the surface of the medium body by heating the ink image-receiving sheet and the medium body overlaid to each other and thereby causing diffusion of the sublimable dye ink held in the ink image-receiving sheet in the surface of the medium body for color development, removing the ink image-receiving sheet from the medium body having the image formed thereon, and taking up the separator separated from the ink image-receiving sheet and the medium body, the sheet cartridge comprising:

said roll of the ink image-receiving sheet;

a supply reel for rolling out the ink image-receiving sheet;

a separator take-up reel for taking up the separator removed from the medium body; and a single cartridge casing accommodating said ink image-receiving sheet, said supply reel, and said sheet take-up reel.

16. A sheet cartridge for use in an image-forming method, the image-forming method including the steps of:

overlaying a medium body to an image-receiving surface of an image-receiving sheet formed separately from the medium body, the image-receiving surface being for receiving an image of a sublimable dye ink, and affixing the medium body and the image-receiving sheet to each other, the ink image-receiving sheet being larger in size than a surface of the medium body, having a separator affixed to an opposite surface thereof to the image-receiving surface thereof, and being rolled out from a roll thereof, separating the ink-receiving sheet and the medium body overlaid and affixed to each other from the separator, printing an image on the image-receiving surface of the ink image-receiving sheet, by using the sublimable dye ink, thereby causing the sublimable dye ink to be held by the ink image-receiving sheet, fixing the image in the surface of the medium body by heating the ink image-receiving sheet and the medium body overlaid to each other and thereby causing diffusion of the sublimable dye ink held in the ink image-receiving sheet in the surface of the medium body for color development, removing the ink image-receiving sheet from the medium body having the image formed thereon, and taking up the separator separated from the ink image-receiving sheet and the medium body, the sheet cartridge comprising:

said roll of the ink image-receiving sheet;

a supply reel for rolling out the ink image-receiving sheet;

a separator take-up reel for taking up the separator removed from the medium body; and a single cartridge casing accommodating said roll of the ink image-receiving sheet, said supply reel, and said sheet take-up reel.

* * * * *